US006106133A

United States Patent [19]

Lee

[11] Patent Number: 6,106,133

[45] Date of Patent: Aug. 22, 2000

[54] ILLUMINATION DEVICE FOR A RATCHETING TOOL

[76] Inventor: Shu-Chen Lee, 3F, No. 1, Alley 3, Lane 80, Min-Sheng East Road, Section 4, Taipei, Taiwan

[21] Appl. No.: 09/389,519

[22] Filed: Sep. 2, 1999

[51] Int. Cl.[7] ..... B25B 23/18

[52] U.S. Cl. ..... 362/119; 362/120

[58] Field of Search ..... 362/109, 119, 362/120, 253, 208

[56] References Cited

U.S. PATENT DOCUMENTS 5,510,962 4/1996 Hsiao ..... 362/120

5,899,554 5/1999 Hsu ..... 362/119

5,971,560 10/1999 Chen ..... 362/119

*Primary Examiner*—Y. Quach

*Attorney, Agent, or Firm*—Alan Kamrath; Oppenheimer Wolff & Donnelly LLP

[57] ABSTRACT

A ratcheting tool includes a handle having a first drive end and a second end. An illumination device includes a base securely attached to the second end of the handle and a cover removably attached to the base. The base and the cover together define a compartment for receiving a lamp that is adapted to provide direct illumination to a fastener to be tightened/loosened by the ratcheting tool. The illumination device further includes a battery unit for supplying electricity to the lamp.

6 Claims, 8 Drawing Sheets

ILLUMINATION DEVICE FOR A RATCHETING TOOL

BACKGROUND OF THE INVENTION

1. Field of the Invention

The present invention relates to an illumination device for a ratcheting tool.

2. Description of the Related Art

FIG. 8 of the drawings illustrates a conventional ratchet wrench 10' having a compartment for receiving batteries 30', a lamp seat 20', and a lamp 21'. A cover plate 12' is provided to enclose these elements. A pivotal member 50' is pivoted to the cover plate 12' and includes a notch 52' for releasably engaging with a hook 19' on the wrench. When illumination is required, the pivotal member 50' is pivoted to a status shown in FIG. 8, in which a conductive plate 60' is moved to be in electrical contact with the lamp 21'. Thus, the lamp 21' is electrically connected to the batteries 30' via wire 61'. Light from the lamp 21' is reflected via a reflective mirror 51' embedded to an inner side of the pivotal member 50'. Nevertheless, the structural strength of the ratchet wrench is weakened as a result of formation of the compartment for receiving the elements. In addition, the illumination effect is unsatisfactory, as the fastener to be tightened/loosened by the ratchet wrench is not directly illuminated.

The present invention is intended to provide a ratcheting tool with an illumination device that mitigates and/or obviates the above problems.

SUMMARY OF THE INVENTION

It is a primary object of the present invention to provide a ratcheting tool with an illumination device that may directly illuminate the fastener to be tightened/loosened by the ratcheting tool.

A ratcheting tool in accordance with the present invention comprises a handle having a drive end and an illumination device securely attached to the handle at a position other than the drive end. The illumination device comprises a lamp that is adapted to provide direct illumination to a fastener to be tightened/loosened by the ratcheting tool.

In accordance with a preferred embodiment of the invention, a ratcheting tool comprises:

a handle having a first drive end and a second end; and an illumination device including a base securely attached to the second end of the handle and a cover removably attached to the base, the base and the cover together defining a compartment for receiving a lamp that is adapted to provide direct illumination to a fastener to be tightened/loosened by the ratcheting tool, the illumination device further including a battery unit for supplying electricity to the lamp.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
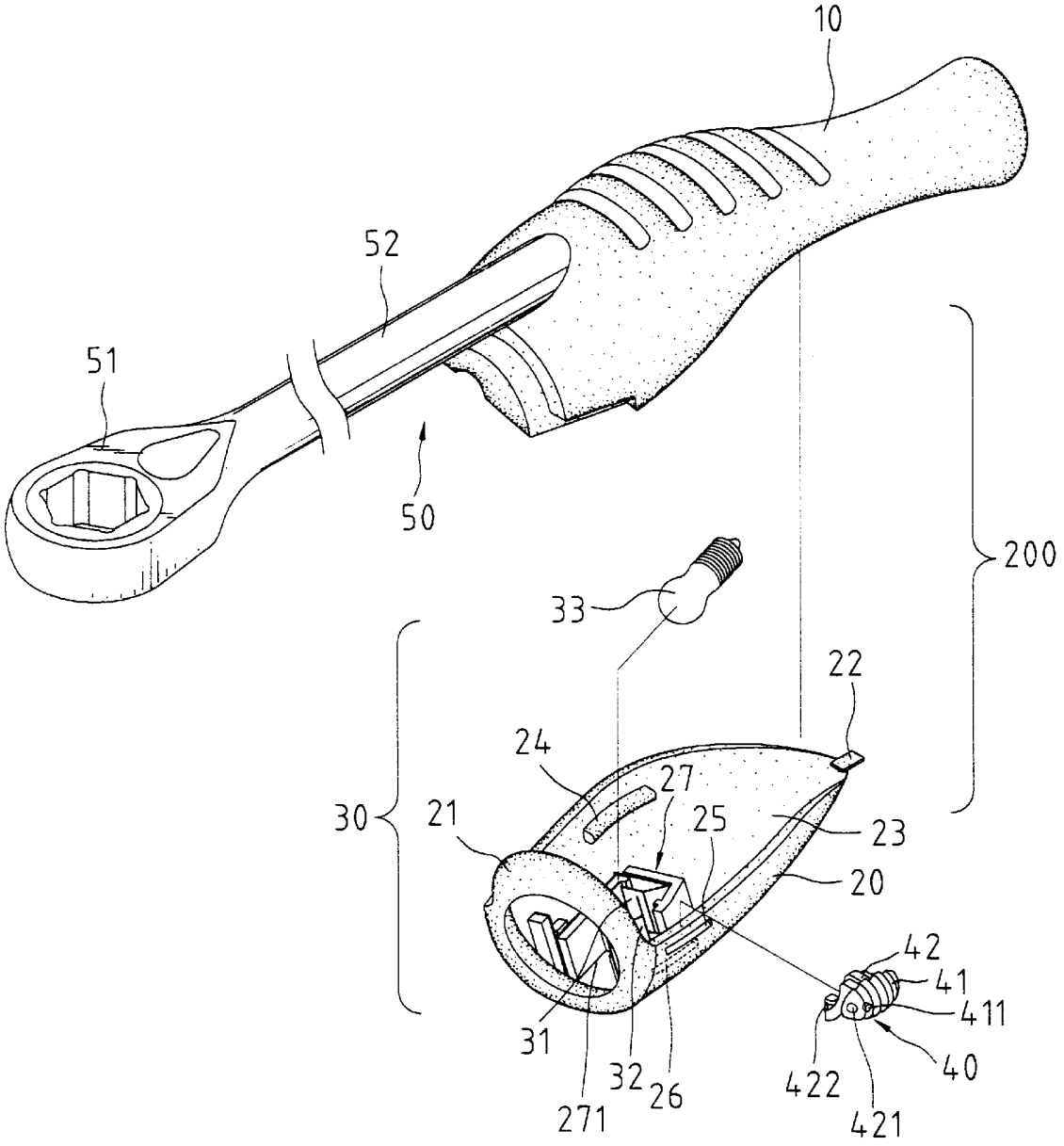
FIG. 1 is an exploded perspective view of a ratcheting tool with an illumination device in accordance with the present invention.

Referring to FIGS. 1 through 7 and initially to FIGS. 1 through 4, a ratcheting tool 50 generally includes a handle 52 with a driving end 51. An illumination device in accordance with the present invention is constructed as a grip 200 and generally includes a base 10 securely attached to the other end of the handle 52 and a cover 20 releasably attached to the base 10.

Figure 2:
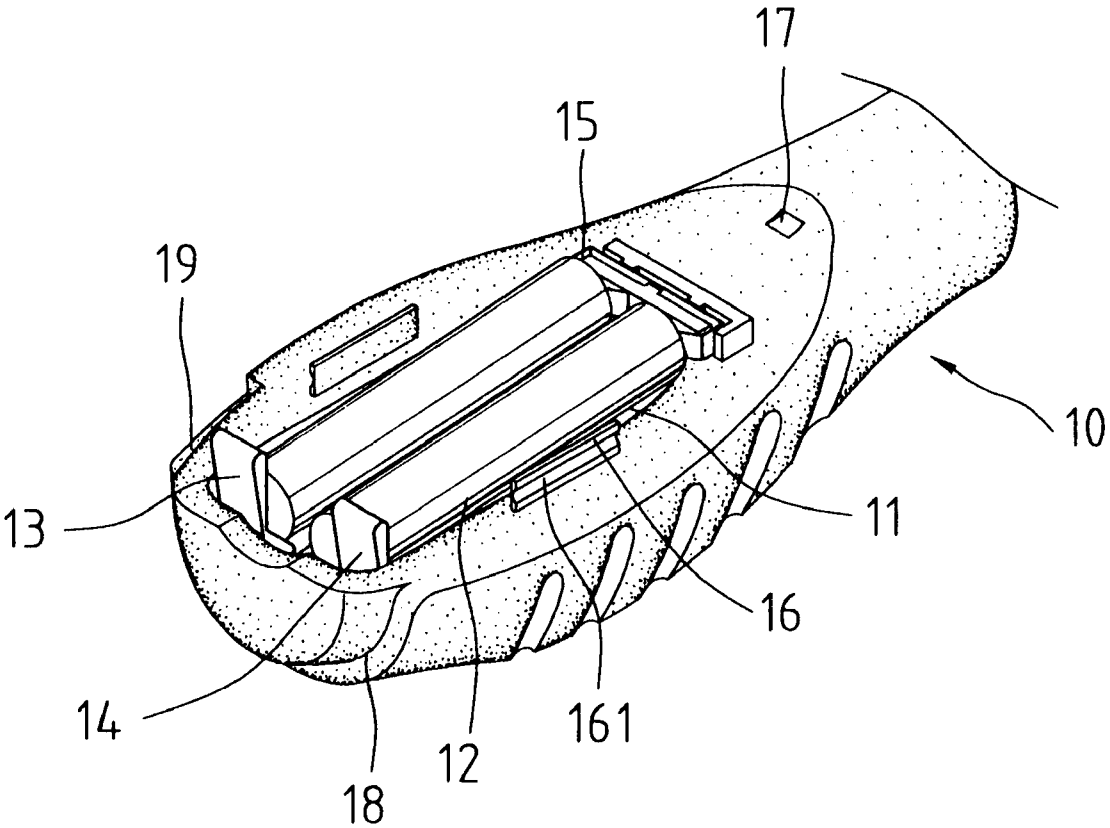
FIG. 2 is a bottom perspective view of a portion of the illumination device in accordance with the present invention.

Referring to FIG. 2, the base 10 includes a battery seat 11 for receiving, e.g., two dry batteries 12. The battery seat 11 includes conductive plates 13, 14, and 15 on both ends thereof, wherein the conductive plates 13 and 14 extend upward beyond the battery seat 11. Two wings 16 are formed on two lateral sides of the battery seat 11, respectively. Each wing 16 includes a recess 161. The base 10 further includes an engaging notch 17 on one end thereof and an engaging section 18 on the other end thereof, the engaging section 18 having a notch 19.

Figure 3:
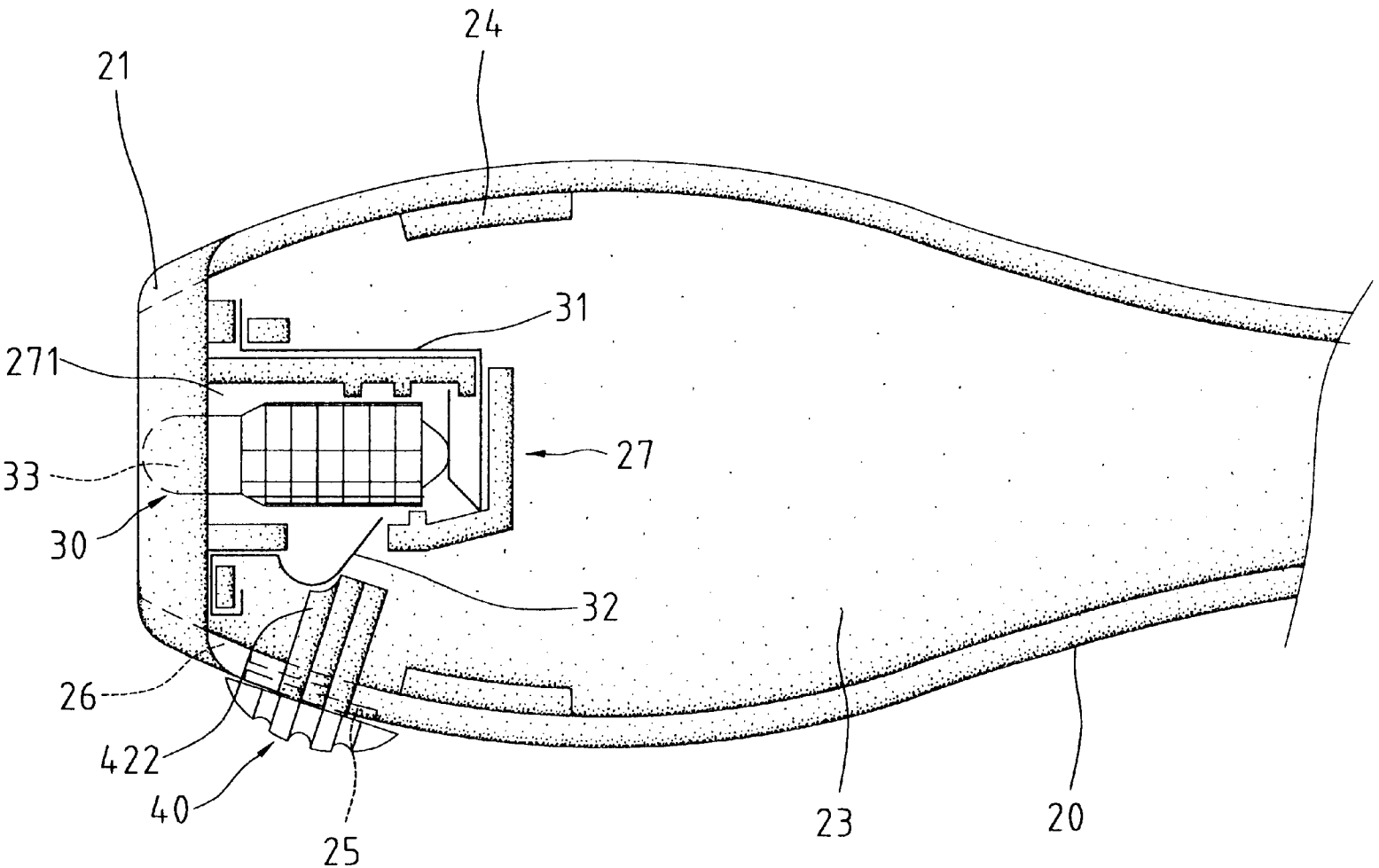
FIG. 3 is an enlarged top view of another portion of the illumination device in accordance with the present invention.
Figure 4:
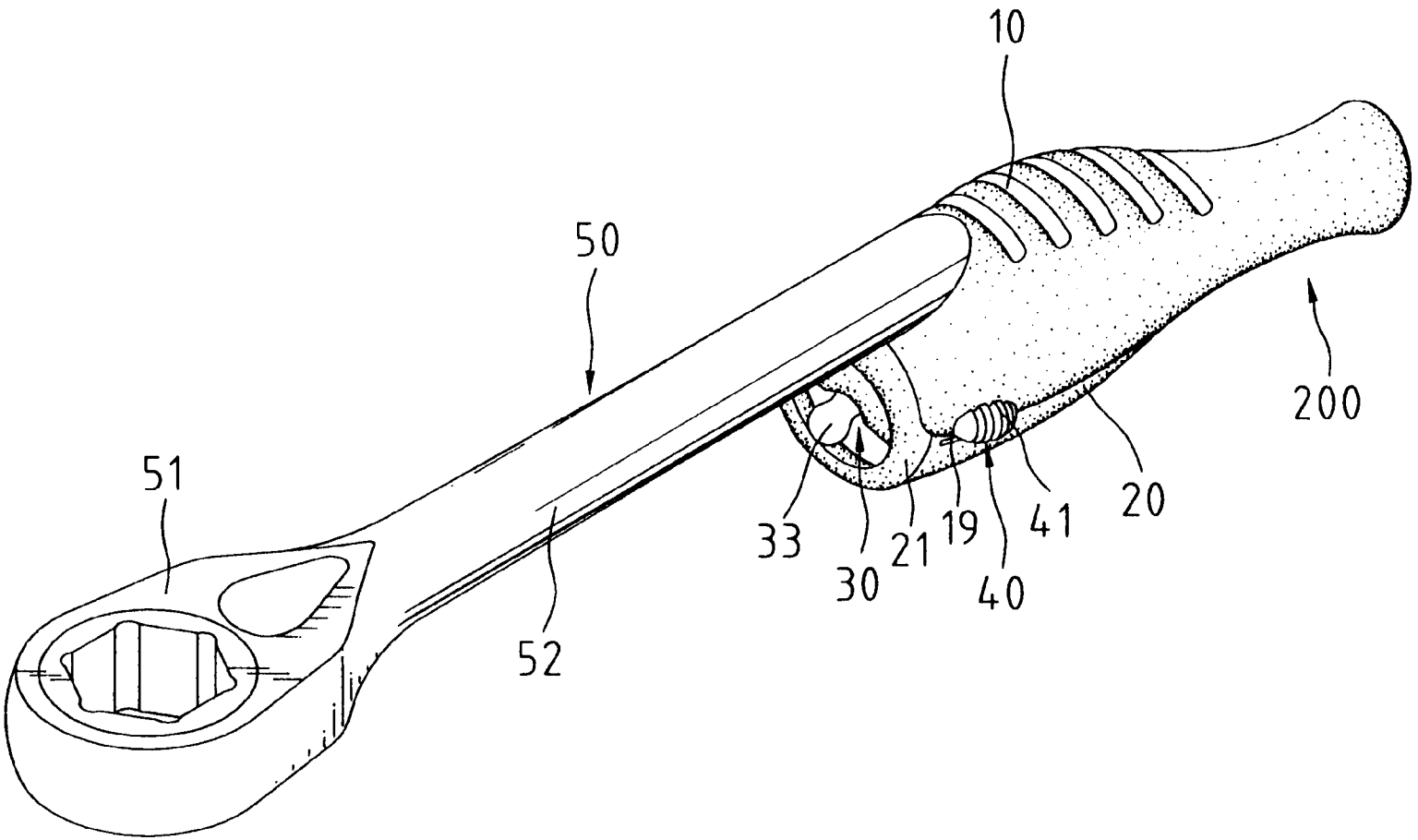
FIG. 4 is a perspective view of the ratcheting tool with the illumination device in accordance with the present invention.

Referring to FIGS. 1 and 3, the cover 20 includes an engaging piece 22 on one end thereof for releasably engaging with the engaging notch 17 of the base 10. The cover 20 further includes a ring 21 on the other end thereof for releasably engaging with the engaging section 18 of the base 10. The cover 20 further includes a compartment 23. Each of two lateral walls of the cover 20 that define the compartment 23 includes a rib 24 formed on an inner face thereof. The ribs 24 are slid into the recesses 161 of the wings 16, respectively. In addition, an outer groove 25 is defined in an outer face of each lateral wall of the cover 20 and an inner groove 26 is defined in an inner face of each lateral wall of the cover 20.

A lamp seat 27 is provided in the compartment 23 of the cover 20 for receiving a lamp 33. As illustrated in FIG. 3, a conductive end of the lamp 33 is electrically connected to a first conductive plate 31. A second conductive plate 32 is disposed adjacent to conductive peripheral portion of the lamp 33. A switch 40 is provided to cause the second conductive plate 32 to be electrical contact with the conductive peripheral portion of the lamp 33. In this embodiment, the switch 40 includes a main body 41 for finger's operation. An L-shape leg 42 projects from the main body 41 and with the main body 41 defines a space. The space defined by the leg 42 and the main body 41 is adapted to receive upper edge of the associated lateral wall of the cover 20, thereby allowing the switch 40 to be slidably attached to the cover 20. The main body 41 includes a protrusion 411 facing the leg 42 and slidably received in the outer groove 25. The leg 42 includes a protrusion 421 facing the main body 41 and slidably received in the inner groove 26. The leg 42 further includes an operative section 422 that may move the second conductive plate 32 to a position in electrical contact with the conductive peripheral portion of the lamp 33 upon manual operation of the switch 40. The notch 19 in the base 10 provides a space for sliding movement of the switch 40.

Figure 5:
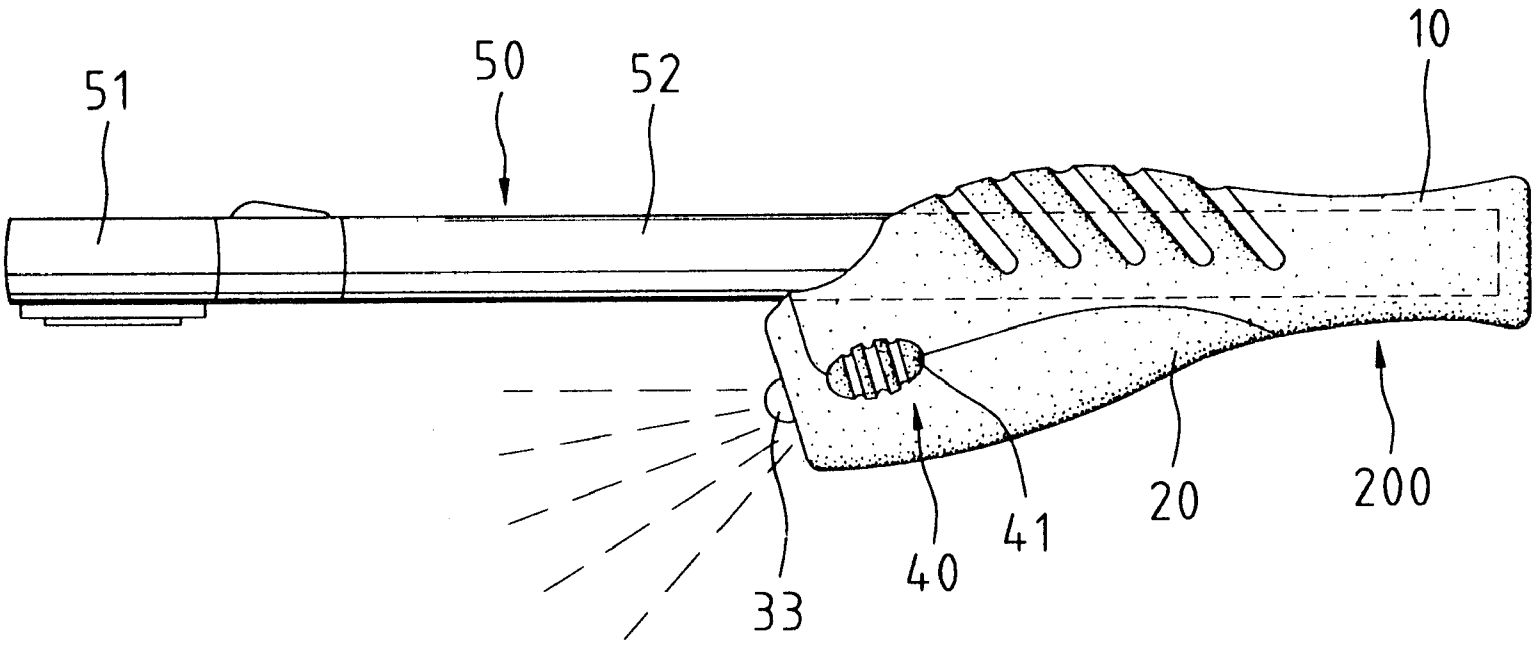
FIG. 5 is a schematic side view illustrating use of the illumination device.

In assembly, the base 10 is securely attached to the handle 52 of, e.g., a ratchet wrench 50 with a driving end 51 of the type having a through-hole (not labeled). The cover 20 is then attached to the base 10, wherein the ribs 24 of the cover 20 are engaged in the recesses 161 of the base 10 and the engaging piece 22 is engaged in the engaging notch 17. The switch 40 is exposed outside for finger's operation. The conductive plates 13 and 14 on the base 10 are in electrical contact with the first and second conductive plates 31 and 32, respectively, such that the lamp 33 is turned on if the switch 40 is moved to an ON position. Thus, as shown in FIG. 5, the lamp 33 provides direct illumination to the fastener (not shown) to be tightened/loosened.

Figure 6:
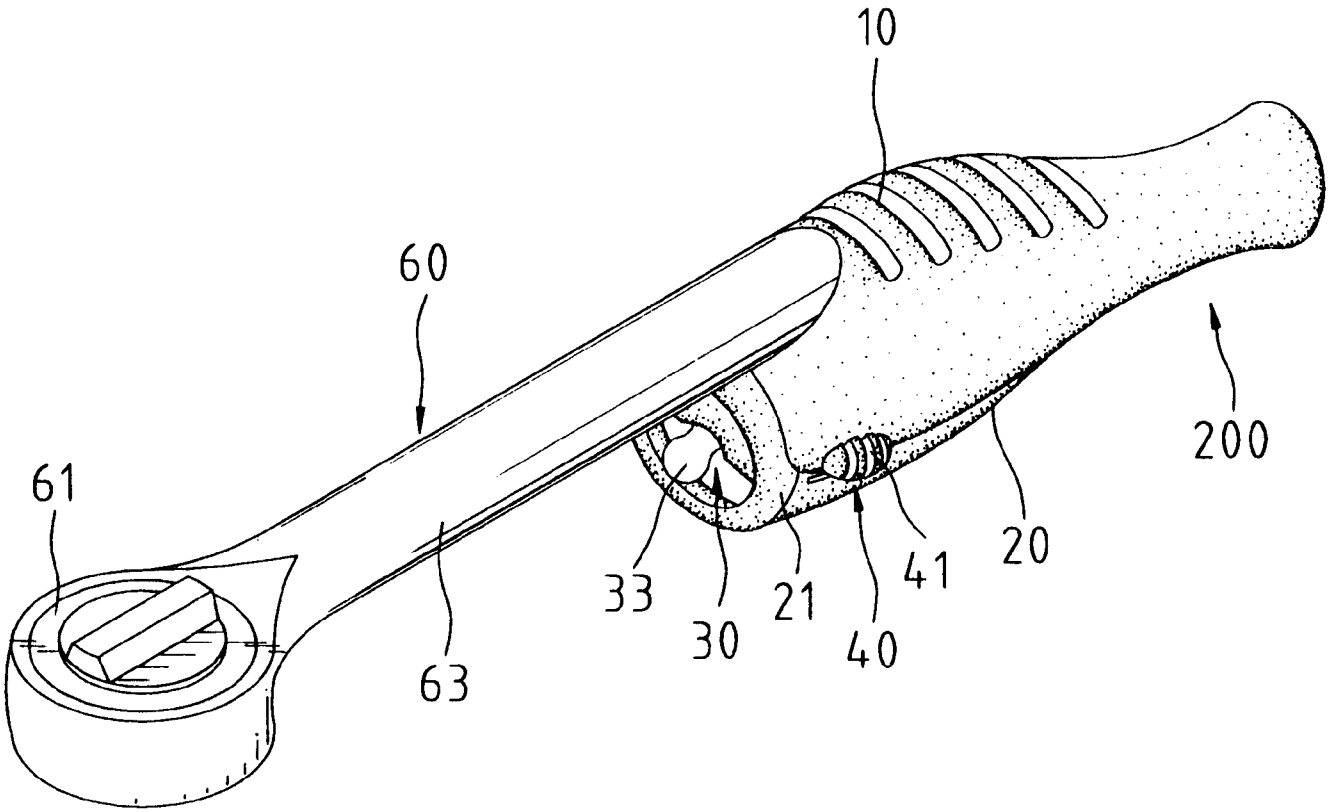
FIG. 6 is a perspective view illustrating application of the illumination device of the present invention on a ratcheting tool of another type.
Figure 7:
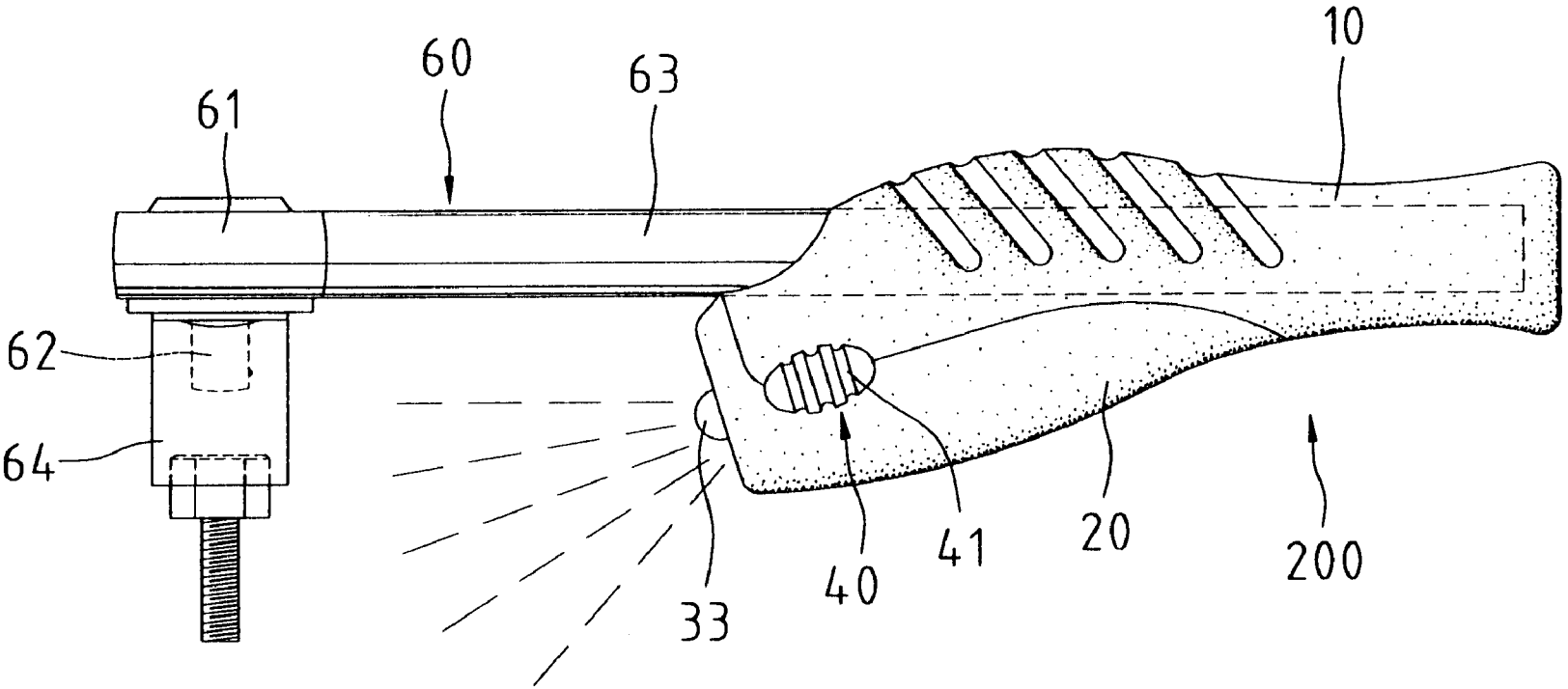
FIG. 7 is a schematic side view illustrating use of the illumination device on the ratcheting tool in FIG. 6.
Figure 8:
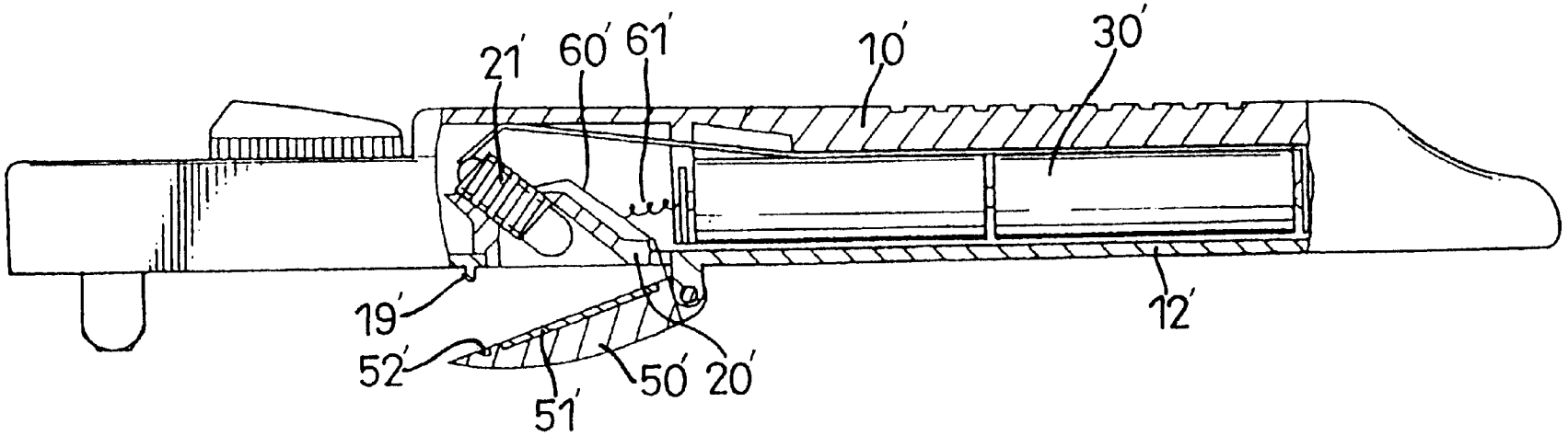
Fig. 8 PRIOR ART
FIG. 8 is a partially sectioned side view of a ratchet wrench with a conventional illumination device.

FIGS. 6 and 7 illustrate application of the illumination device of the present invention on a socket wrench 60 having a handle 63 and a drive end 61 with a drive member 62 for engaging with a socket 64. Thus, as shown in FIG. 7, the lamp 33 provides direct illumination to the fastener (not labeled) to be tightened/loosened.

According to the above description, it is appreciated that the illumination device provides direct illumination (rather than in reflective manner) to the fastener to be tightened/loosened, as the lamp 33 is arranged to extend in a direction toward the fastener to be tightened/loosened. In addition, the structural strength of the ratcheting tool is not adversely affected.

Although the invention has been explained in relation to its preferred embodiment, it is to be understood that many other possible modifications and variations can be made without departing from the spirit and scope of the invention as hereinafter claimed.

What is claimed is:

1. A ratcheting tool comprising:

a handle having a first drive end and a second end; and an illumination device including a base securely attached to the second end of the handle and a cover removably attached to the base, the base and the cover together defining a compartment for receiving a lamp that is adapted to provide direct illumination to a fastener to be tightened/loosened by the ratcheting tool, the illumination device further including a battery unit for supplying electricity to the lamp;

wherein the cover includes two lateral walls each having an inner face and an outer face, a rib being formed on the inner face of each said lateral wall, the base including two spaced wings each having a recess for releasably engaging with an associated said rib.

2. The ratcheting tool as claimed in claim 1, wherein the illumination device further comprises a switch for controlling on and off of the lamp.

3. The ratcheting tool as claimed in claim 1, wherein the base includes an engaging notch, and wherein the cover includes an engaging piece for releasably engaging with the engaging notch.

4. The ratcheting tool as claimed in claim 2, wherein the switch includes a main body with an L-shape leg projected therefrom, the leg and the main body having a space therebetween for receiving a portion of an upper edge of said lateral walls of the cover, thereby allowing the switch to be slidably mounted to the cover.

5. The ratcheting tool as claimed in claim 4, wherein the inner face of one of the lateral walls includes a groove and wherein the main body of the switch includes a protrusion slidably received in the groove.

6. The ratcheting tool as claimed in claim 4, wherein the outer face of said one of the lateral walls includes a groove and wherein the leg of the switch includes a protrusion slidably received in the groove.

* * * * *